United States Patent [19]

Baker

[11] 4,286,697

[45] Sep. 1, 1981

[54] BODY-ATTACHABLE BAG FOR CARRYING CAMERAS OR THE LIKE

[75] Inventor: Robert A. Baker, Dandridge, Tenn.

[73] Assignee: Engineered Products, Inc., Dandridge, Tenn.

[21] Appl. No.: 109,158

[22] Filed: Jan. 2, 1980

[51] Int. Cl.[3] ..... A45C 3/10; A45C 13/00; A45C 13/30

[52] U.S. Cl. ..... 190/48; 150/28 A; 150/DIG. 1; 224/208; 224/224

[58] Field of Search ..... 190/48, 52, 50; 150/52 J, 52 E, 28 A; 224/47, 58, 188, 190, 206, 208, 215, 216, 224

[56] References Cited

U.S. PATENT DOCUMENTS

| | | | |
|---|---|---|---|
| 2,107,347 | 2/1938 | Sloane | 150/28 A |
| 3,447,649 | 6/1969 | Kish | 190/50 |
| 3,550,663 | 12/1970 | Johnston | 150/28 A |
| 3,696,850 | 10/1972 | Rosenblum | 190/52 |

*Primary Examiner*—Herbert F. Ross
*Attorney, Agent, or Firm*—Luedeka & Fitch

[57] ABSTRACT

A shoulder suspended semi-flexible bag configured to conform to and substantially wrap the torso of a carrier, comprising flexible crease resistant panel means secured to the sides of the bag, reinforcing support thereto, such panel means being capable of sufficient flexing as permits the bag to be turned insideout without permanently creasing the reinforcing panels.

1 Claim, 4 Drawing Figures

BODY-ATTACHABLE BAG FOR CARRYING CAMERAS OR THE LIKE

This invention relates to bags for transporting articles such as cameras and particularly to such a bag that is adapted to be suspended in over the shoulder fashion and in contact with a person's torso.

Bags adapted to be carried by suspending the bag from a person's shoulder are well known in the art. These include shoulder bags, luggage, gadget bags and the like. Other bags adapted to be anchored to a person's torso are also well known, for example, the well known knapsack. These prior bags, when suspended, tend to swing relative to the person's body during walking movements, unless anchored, thereby becoming most annoying and bothersome. This problem is accentuated when the bag carries a relatively heavy object that imparts a blow to the wearer as the bag swings.

In the prior suspended bags and the prior anchored bags, the bags commonly are substantially rigid so as to be self-supporting and protective of the contents of the bag. In this manner they also maintain their desired shape and retain their original pleasing aesthetic appearance. Such rigidity, however, presents problems in that these rigid bags have limited areas of physical contact with the person's body thereby developing pressure points that create discomfort, particularly when transporting heavy articles. The rigidity of these bags further increases the discomfort when a suspended bag strikes the wearer. In certain back packs, it has been proposed to provide a rigid frame which is contoured to fit a person's back. These frames provide support for a limp bag and, of course, are unsuitable for over-the-shoulder suspension use and provide little or no shock protection to the contents of the bag.

Other bags or cases having shock absorbing characteristics are also known in the art. These bags frequently are bulky, hence cumbersome to carry. They further commonly are relatively expensive to manufacture.

The present inventor has discovered a bag construction that provides shock absorption and which is suitable for over-the-shoulder suspension. The bag is particularly suitable for carrying cameras or the like. The bag is constructed of a plurality of panels that individually are substantially nonself-supporting but which collectively interact with one another to develop and maintain a geometry of the bag that substantially conforms to, i.e., partially wraps, the person's torso over a substantial surface area thereby having a reduced tendency to swing when suspended from the shoulder and substantially reducing the undesirable pressure points. In general, the new bag comprises first and second panels that define the top, and portions of the ends, of the bag, plus a top opening, and further panels that define the opposite sides and bottom of the bag. In one embodiment, the bottom panel extends upwardly to complete the ends of the bag. In the bag, each of the first and second panels is elongated and has one nonstraight side edge (when flat). The nonstraight, and outboard, side edge of the first panel is concave in that portion thereof which is disposed on the top of the bag, whereas, the nonparallel outboard side edge of the second panel is convex in that portion thereof which is disposed on the top of the bag. The other, i.e., inboard, of the side edges of the first and second panels are contiguous to one another and define a top opening to the bag. Closure means, such as a zipper, is provided along these contiguous side edges of the first and second panels. The bottom panel is provided with like concave and convex outboard side edges that are in vertical register with the concave and convex side edges of the top panels so that when the side panels are joined about their perimeters to the outboard side edges of the top and bottom panels, the side panels are forced to assume respective concave and convex geometries. Each of the panels is individually flexible and substantially nonself-supporting. However, as found by the present inventor, by joining the panels one to another as described herein, the bag as a whole assumes a geometry that conforms, on one side, to the contour of a person's torso so that the bag tends to hug the torso and resist swinging. Further, there is developed a relatively large area of physical contact of the bag with the torso thereby reducing the development of pressure points, even when the bag carries heavy articles, such as a camera for example. Straps are provided for shoulder suspension of the bag. Alternatively other straps may be provided for otherwise anchoring the bag to a person.

In the manufacture of the present bag, preferably the several panels are joined to one another as by stitching. Thus, it is necessary that the bag be assembled with its inside surfaces facing outwardly to permit seam formation. Therefore, the bag must be amenable to be turned after assembly. This maneuver is not particularly problematical when the bag is made up of limp panels, but heretofore it has not been possible to provide planar reinforcing to the bag side or end walls or bottom because such either prevented turning of the bag or the bending of the reinforcing during bag turning substantially destroyed the rigidity of the planar reinforcing. In one embodiment of the present bag which is particularly useful in transporting fragile articles, such as cameras and its small accessories, there is provided novel planar reinforcing in selected ones of the bag walls which is crease resistant, but substantially rigid to provide the desired reinforcement.

It is therefore an object of this invention to provide an improved shock absorbing bag for securement to a person's torso, such bag having a reduced tendency to shift relative to the torso and having a reduced tendency to develop pressure points. Other objects and advantages will be apparent from the following description including the claims and the drawings in which:

Figure 1:
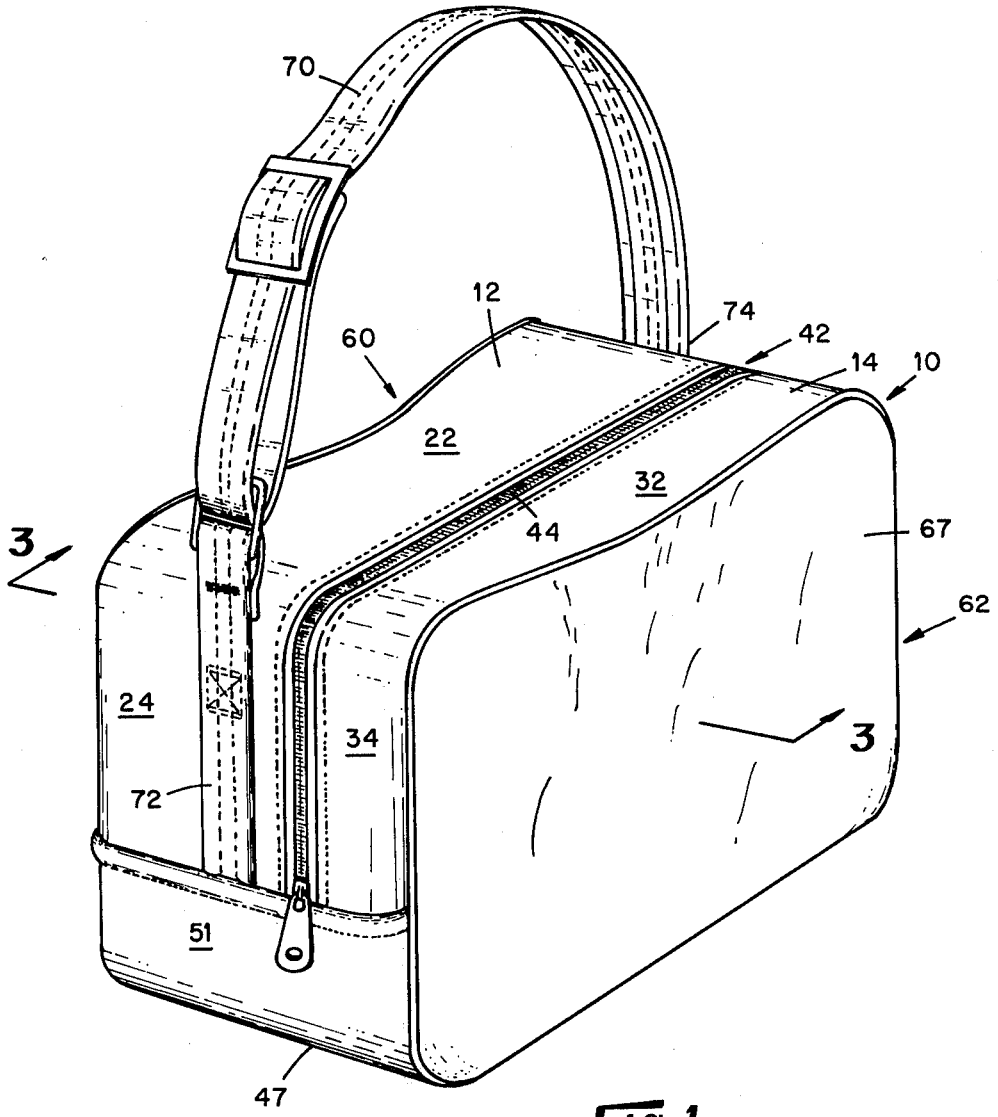
FIG. 1 is a perspective view of a bag embodying various features of the invention.
Figure 2:
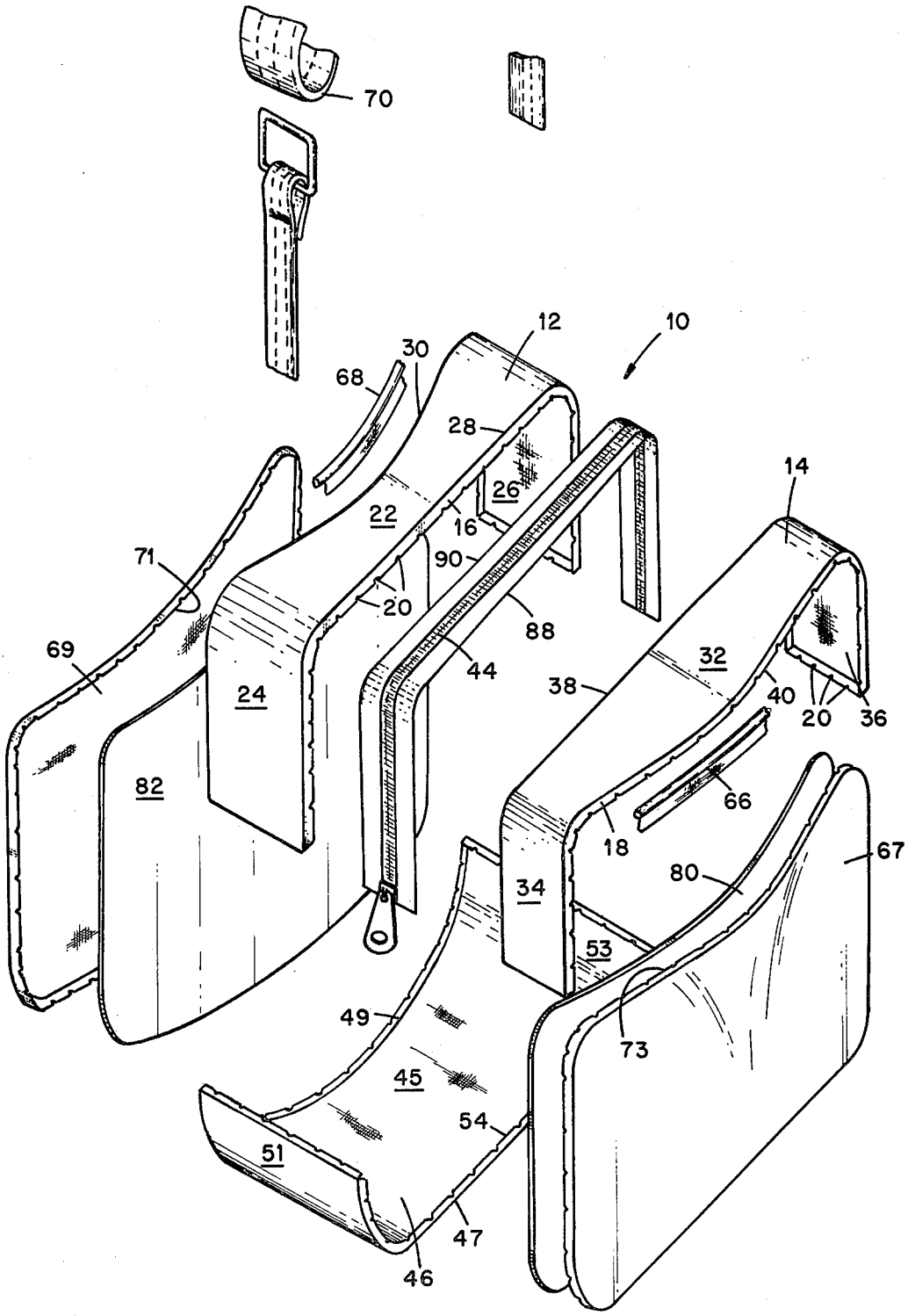
FIG. 2 is an exploded view, partly fragmentary, of the bag depicted in FIG. 1.

With reference to FIG. 1, one embodiment of the depicted bag 10 comprises first and second panel members 12 and 14, respectively, each of which is provided with an inturned perimetral edge 16 and 18, having triangular notches 20 cut therein to facilitate bending or shaping for assembly and binding. As seen in FIG. 2, the first panel 12 comprises a central portion 22 that defines one side of the top of the bag and opposite end portions 24 and 26 that are bent downwardly from the top of the bag in a U-shape to define a substantial part of each of the opposite ends of the bag. This depicted panel 12, when laid out flat, includes a straight side edge 28 and an opposite non-parallel, i.e., nonstraight, outboard side edge 30. The side edge 30, in the central portion thereof is curved inwardly of the panel to define a concave side edge in such central portion.

The second panel 14 similarly includes a central portion 32 that defines the opposite side of the top of the bag and opposite end portions 34 and 36 that are bent downwardly from the top of the bag in a U-shape to define a further substantial part of the opposite ends of the bag. This panel 14, is essentially equal in length to the first panel 12 and is coterminal therewith in the completed bag, but is more narrow in width than the first panel, and, when laid out flat, includes a straight side edge 38 and an opposite non-parallel, i.e., non-straight, outboard side edge 40. The side edge 40, in the central portion thereof, is curved outwardly of the panel to define a convex side edge in the central portion of the panel. As depicted, the straight side edges 28 and 38 are disposed in contiguous side-by-side alignment to define a top opening of the bag, indicated by the numeral 42, and which extends across the full width of the bag and further down along each of the opposite ends of the bag by a substantial distance. Because of the uneven widths of the first and second panels, the top opening is "off-center" toward the front of the top of the bag, thereby permitting the attachment of strap means approximately centrally of each of the opposite ends of the bag and position the opening toward the front of the bag for ready access to the bag without removing it from its suspended position. Closure means such as a zipper 44 is joined along its opposite side edges to and between the contiguous side edges 28 and 38 to provide for selective opening and closing of the bag. Notably, in a preferred embodiment, the zipper extends downwardly from the top of the bag along each of the opposite ends of the bag by a substantial distance. By this means, when the zipper is fully opened, the second (front) top panel 14 is foldable down and outwardly of the bag to provide an opening for access to the bag which has a major dimension that is greater than the width dimension of the bag. It is to be understood that the contiguous side edges 28 and 38 of the first and second top panels need not be straight but can assume other configurations, such as an arcuate configuration. It is important, however, that these side edges be substantially contiguous to one another so as to provide for closing the top of the bag.

Referring to FIG. 2, the bag 10 further includes a bottom panel 46 which defines the bottom of the bag. This bottom panel 46 includes a central portion 45 provided with substantially parallel, but nonstraight opposite side edges 47 and 49. The back side edge 49 curves inwardly of the panel 46 to define a concave edge that is of substantially the same geometry as the outboard side edge 30 of the first top panel 12 and is disposed on the same side of the bag as is the side edge 30 and in vertical register therewith. The opposite side edge 47 (front side edge) of the bottom panel is of a convex geometry that is substantially identical to the convex geometry of the outboard side edge 40 of the second top panel 14, is on the same side of the bag and in vertical register with such edge 40. The opposite end portions 51 and 53 of the bottom panel are bent upwardly to define substantial portions of the opposite ends of the bag. In a preferred embodiment for use as a camera bag, the concave side edges of the first top panel and the bottom panel have a radius of curvature of about five and one-fourth inches.

The front and back sides of the bag are closed as by planar panels 67 and 69, each of which is provided with an inturned, notched perimetral edge 71 and 73. This perimetral edge is suitable for joining a side panel to the adjacent perimetral edges of the top, bottom and end panels. It is to be noted that the side panels 67 and 69 are depicted in FIG. 2 as having a curvilinear geometry only for purposes of illustration. Before assembly, these panels, as well as each of the other panels in the bag, are planar, i.e., laid out flat. Only after assembly do the panels adopt their respective geometries.

Strap means 70, preferably of adjustable length, is secured at its opposite ends 72 and 74 to the opposite ends of the bag to extend upwardly from the bag and provide the means for supporting the bag from a person's shoulder.

In the embodiment of the present bag shown in FIGS. 1 and 2, each of the panels is of an identical material, specifically a laminate comprising expanded vinyl foam of between 20 and 75 gauge to which there has been bonded a circle knitted tricot lining on at least one planar surface thereof. This particular material is available from Pervel Corp., Plainfield, Connecticut and is identified as 5055 gauge expanded vinyl with knit backing. This laminate is substantially self-supporting, is resilient, and when bent and released, it tends to seek its original planar geometry. If this laminate experiences substantial restraint against its recovery to its planar geometry, it will not so recover, however. This factor can cause a bag made up of the laminate to not be aesthetically pleasing and even unsuitable for use as regards its shape retention. This shortcoming of the laminate is overcome through the use of planar crease resistant reinforcing panels as described hereinafter. The laminate is substantially nonstretchable and noncompressible in the planar dimension thereof. The foam may be open or closed cell, but in any event, it provides a substantial cushioning effect to articles carried in the bag. Further, the tricot lining is disposed inside the finished bag where it provides a soft surface for protecting articles against abrasion, scratching, etc. Importantly, the tricot lining is itself expansible within its planar dimension and out of its planar dimension so that when the foam layer beneath the tricot lining is deformed, as when absorbing shock forces, the tricot lining both yields with the foam and tends to recover to its original geometry after the deforming force has been removed.

In assembling the bag depicted in FIGS. 1 and 2, the individual panels are joined one to another in the relationship shown in FIG. 2, along their respective perimetral edges, as by stitching. In the depicted embodiment, welt means 66 and 68 is included in each of the seams which join the side panels 67 and 69 to respective ones of the first and second top panels and to the respective sides of the bottom panel 46. It is to be noted that the joining of the several elements of the present bag must be accomplished while the bag is turned inside out so as to expose the contiguous side edges of the various elements for stitching purposes. Following its assembly, of course, the bag is turned so that the stitched edges are disposed internally of the bag to thereby provide an attractive joinder along each of the contiguous edges of the several elements on the exterior of the bag.

Figure 3:
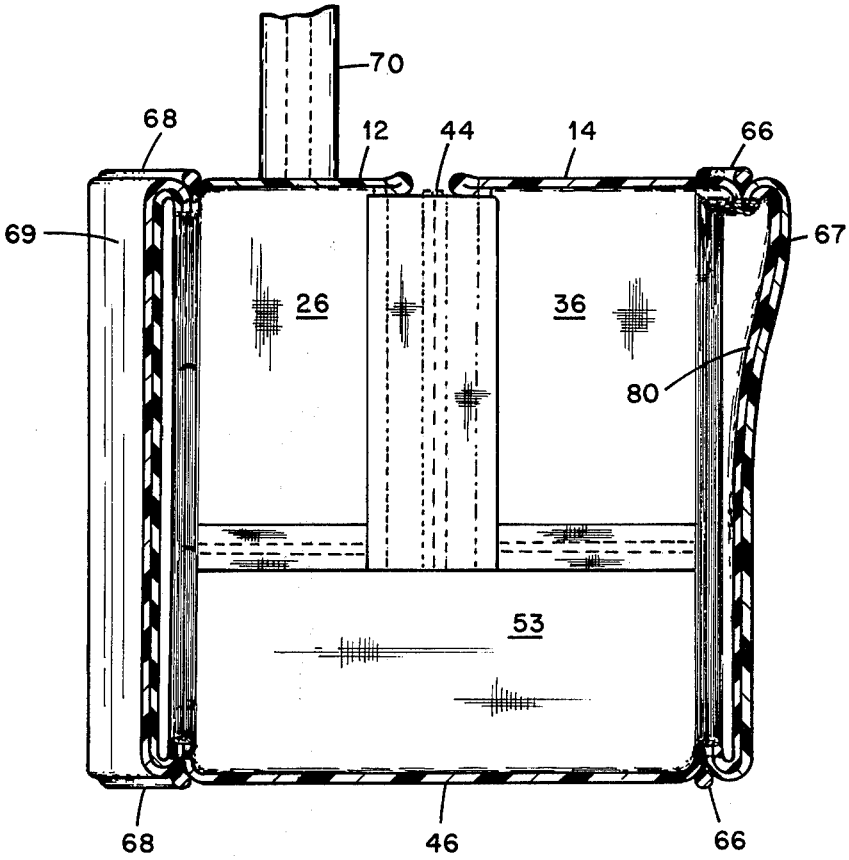
FIG. 3 is a sectional view taken generally along the line 3—3 of FIG. 1.
Figure 4:
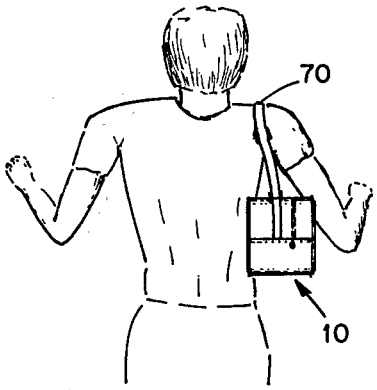
FIG. 4 depicts a bag as disclosed herein in a position of use in contact with a person's torso.

With reference to FIGS. 2 and 3, the present bag is provided with side reinforcing planar panels 80 and 82, each of which is essentially identical in size to a corresponding one of the side panels 67 and 69. Each of the reinforcing panels 80 and 82 is of identical material, specifically a crease resistant, but flexible material such as the rubberized fabric identified by the trade name Pellon and further identified as 1246L, and available commercially from the Pellon Corporation, Chelmsford, Massachusetts. A 60 gauge Pellon is preferred for camera bags, for example. This material is substantially incompressible within its planar dimension and possesses sufficient elasticity to permit the material to be bent to the degree necessary to turn a sewn bag inside out and then to cause the reinforcing panel to recover to its original planar geometry. In and of itself, a reinforcing panel provides relatively small resistance to distortion out of its planar geometry, but when sewn into the present bag, each panel interacts with the remaining panels and particularly with the foam laminate panels to develop an unexpected tendency of the bag to retain the geometry which is developed when the several panels are joined as described and shown in the Figures. This synergestic effect has been found to provide a bag that retains the desired geometry which provides conformity to a person's torso while providing the desired protection for the contents of the bag.

While a preferred embodiment has been shown and described herein, it will be understood that there is no intent to limit the invention by such disclosure, but rather, it is intended to cover all modifications and alternate constructions falling within the spirit and scope of the invention as defined in the appended claims.

What is claimed is:

1. A bag particularly suitable for transporting an article in a suspended position alongside of and in substantial wrapping contact with the user's body and having a reduced tendency to swing relative to such user's body during the user's walking or other movements, said bag comprising strap means of suitable length to overwrap the shoulder of a user and having its opposite ends extending downwardly from such shoulder in the direction of a user's waist, first flexible elongated panel means formed into a generally inverted U-shape with its base portion defining a substantial portion of the top of said bag and its leg portions defining substantial portions of the opposite ends of said bag, said ends of said strap being secured to respective ones of said leg portions, second elongated panel means of substantially the same length as and substantially coterminal with said first panel means but of more narrow width disposed in side-by-side relation to said first panel means with one of the side edges of said first panel means being contiguous to one of the side edges of said second panel means, said contiguous side edges being aligned along the aforesaid U-shape to define a top opening in said bag, closure means extending along said contiguous side edges and adapted to releasably join said side edges to one another, third elongated flexible panel means formed into a generally U-shape with its base portion defining the bottom of said bag and its leg portions extending upwardly to respective positions on the opposite ends of said bag, each of said leg portions of said third panel means terminating adjacent the coterminal ends of said first and second panel means, means joining each of said ends of said third panel means to said respective coterminal ends of said first and second panel means, first side panel means, means joining said first side panel means along its perimeter to the outboard side edges of said first and third panel means to close one side of said bag, second side panel means, means joining said second side panel means along its perimeter to the side edges of said second and third panel means to close the opposite side of said bag, said first panel means having one side edge which is outboard and concave with respect to the length dimension of said first panel along that portion thereof which is disposed on the top of said bag, said third panel means having one side edge which is outboard and concave with respect to the length dimension of said third panel in that portion thereof which is disposed on the bottom of said bag whereby said second side panel, when joined to said side edges as aforesaid, is caused to assume a concave geometry, and flexible crease resistant panel means, having greater regidity than said concave side panel, secured in contact with said concave side panel.

* * * * *